US005992296A

United States Patent [19]

Murata

[11] Patent Number: 5,992,296

[45] Date of Patent: Nov. 30, 1999

[54] HYDRAULIC PUMP

[75] Inventor: Yukio Murata, Tokyo, Japan

[73] Assignee: Akebono Brake Industry Co., Ltd., Tokyo, Japan

[21] Appl. No.: 08/993,038

[22] Filed: Dec. 18, 1997

[30] Foreign Application Priority Data

Dec. 19, 1996 [JP] Japan ..... 8-339990

[51] Int. Cl.[6] ..... F01B 19/00

[52] U.S. Cl. ..... 92/90; 92/89

[58] Field of Search ..... 92/89, 90, 91, 92/85 R

[56] References Cited

U.S. PATENT DOCUMENTS

| | | | |
|---|---|---|---|
| 862,867 | 8/1907 | Eggleston | 417/390 |
| 2,515,100 | 7/1950 | Bornstein | 92/85 R |
| 3,270,684 | 9/1966 | Pasquali et al. | 92/90 |
| 3,945,770 | 3/1976 | Welker | 92/90 |
| 4,666,378 | 5/1987 | Ogawa | 92/85 R |
| 5,052,276 | 10/1991 | Halsey | 92/90 |

FOREIGN PATENT DOCUMENTS

| | | |
|---|---|---|
| 57-123984 | 8/1982 | Japan . |
| 58-92485 | 6/1983 | Japan . |
| 5-145139 | 6/1993 | Japan . |

*Primary Examiner*—Thomas E. Denion
*Attorney, Agent, or Firm*—Morgan, Lewis & Bockius LLP

[57] ABSTRACT

In a hydraulic pump, an elastic sealing member for performing sealing between a cylinder and a slide piston reciprocating in the cylinder is provided in the front end side of the slide piston and along the inner circumferential surface of the cylinder so that the elastic sealing member receives a compression force from a front end surface of the slide piston in a compression stroke of the slide piston and swells into a pump chamber because of elastic deformation due to the compression force to thereby reduce the volume of the pump chamber. Accordingly, the elastic deformation of the elastic sealing member in the compression stroke is used to increase the discharge quantity.

10 Claims, 4 Drawing Sheets

HYDRAULIC PUMP

BACKGROUND OF THE INVENTION

1. Field of the Invention

The present invention relates to a hydraulic pump for discharging a fluid by means of a slide piston reciprocating in a cylinder and particularly relates to an improvement for facilitating assembling and, at the same time, heightening discharge efficiency.

2. Description of the Related Art

In general, a hydraulic pump comprises a slide piston reciprocating in a cylinder to compress/expand the volume of a pump chamber in the cylinder, a suction valve for opening an inlet provided in the pump chamber in an expansion stroke of the slide piston, a discharge valve for opening an outlet of the pump chamber in a compression stroke of the slide piston, and an elastic sealing member provided between the cylinder and the slide piston to prevent a fluid in the pump chamber from leaking out of a gap between the slide piston and the cylinder, in which the fluid is discharged by the reciprocating motion of the slide piston.

In such a hydraulic pumps, a pump using a cylinder having a relatively large diameter and using a capped-cylindrical piston as the slide piston is called a piston pump, and a pump using a cylinder having a relatively small diameter and using a round-rod-like plunger as the slide piston is called a plunger pump.

As shown in FIG. 6, in the conventional hydraulic pump, generally, a circumferential groove 2 is formed in the inner circumference of the cylinder 1 so that a ring-like elastic sealing member 3 fitted into the groove 2 is brought into elastic contact with the outer circumference of the slide piston 4 such as a piston, a plunger, or the like, to thereby prevent the fluid in the pump chamber 5 from leaking out of a gap 6 between the cylinder 1 and the slide piston 4.

In the way of providing the elastic sealing member 3 as shown in FIG. 6, however, the elastic sealing member 3 is displaced and deformed in a direction of departing from the pump chamber 5 as represented by the arrow (A), by the pressure of the fluid in the pump chamber 5 to increase the substantial volume of the pump chamber 5 as shown in FIG. 7 when the discharge pressure is high. The increment of the volume of the pump chamber 5 due to the displacement and deformation of such an elastic sealing member 3 forms an escape space for the fluid compressed by the slide piston 4, so that there arises a problem in the loss of the discharge quantity.

The more the stroke X of a movement of the slide piston 4 decreases, the stronger the influence of this problem becomes so that there is a risk of a serious defect disturbing improvement in the discharge efficiency of the pump.

If accuracy in the fitting of the elastic sealing member 3 into the groove 2 is improved or accuracy in the fitting of the slide piston 4 into the cylinder 1 is improved to thereby reduce the displacement and deformation of the elastic sealing member 3, the increase of the volume of the pump chamber due to the displacement and deformation of the elastic sealing member 3 can be reduced. When such fitting accuracy is improved, however, there arises a new problem that the cost of machining increases to thereby bring about the increase in cost or poor assembling property.

SUMMARY OF THE INVENTION

Therefore, an object of the present invention is to solve the aforementioned problems and to provide a hydraulic pump capable of preventing the volume of the pump chamber from increasing due to the displacement and deformation of the elastic sealing member, excellent in assembling property and capable of improving the discharge efficiency without improving the fitting accuracy of cylinder, piston, etc.

According to the present invention, there is provided a hydraulic pump comprising: a cylinder having a pump chamber; a slide piston reciprocating in the pump chamber so as to compress and expand a volume of the pump chamber, whereby a fluid in the pump chamber is discharged; and an elastic sealing member disposed between the cylinder and the slide piston while being compressed so as to prevent the fluid in the pump chamber from leaking out of a gap between the slide piston and the cylinder, wherein the elastic sealing member is disposed on a front end side of the slide piston and along an inner circumferential surface of the cylinder so that the elastic sealing member receives a compression force from a front end surface of the slide piston in a compression stroke of the slide piston and is caused to swell into the pump chamber by elastic deformation due to the compression force to thereby reduce the volume of the pump chamber.

The elastic sealing member is, preferably, shaped cylindrical, and one end of the elastic sealing member is in contact with the front end surface of the slide piston, another end of the elastic sealing member is in contact with an end surface of the pump chamber opposite to the front end surface of the slide piston, and an outer circumferential surface of the elastic sealing member is in contact with the inner circumferential surface of the cylinder.

According to the aforementioned configuration, the elastic sealing member swells into the pump chamber to reduce the volume of the pump chamber in a compression stroke of the slide piston so that the quantity of the fluid discharged from the outlet in a stroke of the movement of the slide piston increases correspondingly to the reduction of the volume of the pump chamber due to the swelling of the elastic sealing member.

Further, in the case where configuration is made so that the elastic sealing member is provided so as to be cylindrical with its one end made to be in contact with the front end surface of the slide piston, its other end made to be in contact with an end surface of the pump chamber opposite to the front end surface of the slide piston, and its outer circumferential surface made to be in contact with the inner circumferential surface of the cylinder, the sealing groove into which the elastic sealing member is fitted is not necessary to be formed in the inner surface of the cylinder or in the outer circumferential surface of the slide piston. Accordingly, the structure of the cylinder or slide piston can be simplified to reduce the cost of production and, further, an positioning operation, or the like, at the time of assembling the elastic sealing member can be facilitated to improve the assembling property more greatly.

DETAILED DESCRIPTION OF THE PREFERRED EMBODIMENTS

Preferred embodiments of the hydraulic pump according to the present invention will be described below in detail with reference to the drawings.

Figure 1:
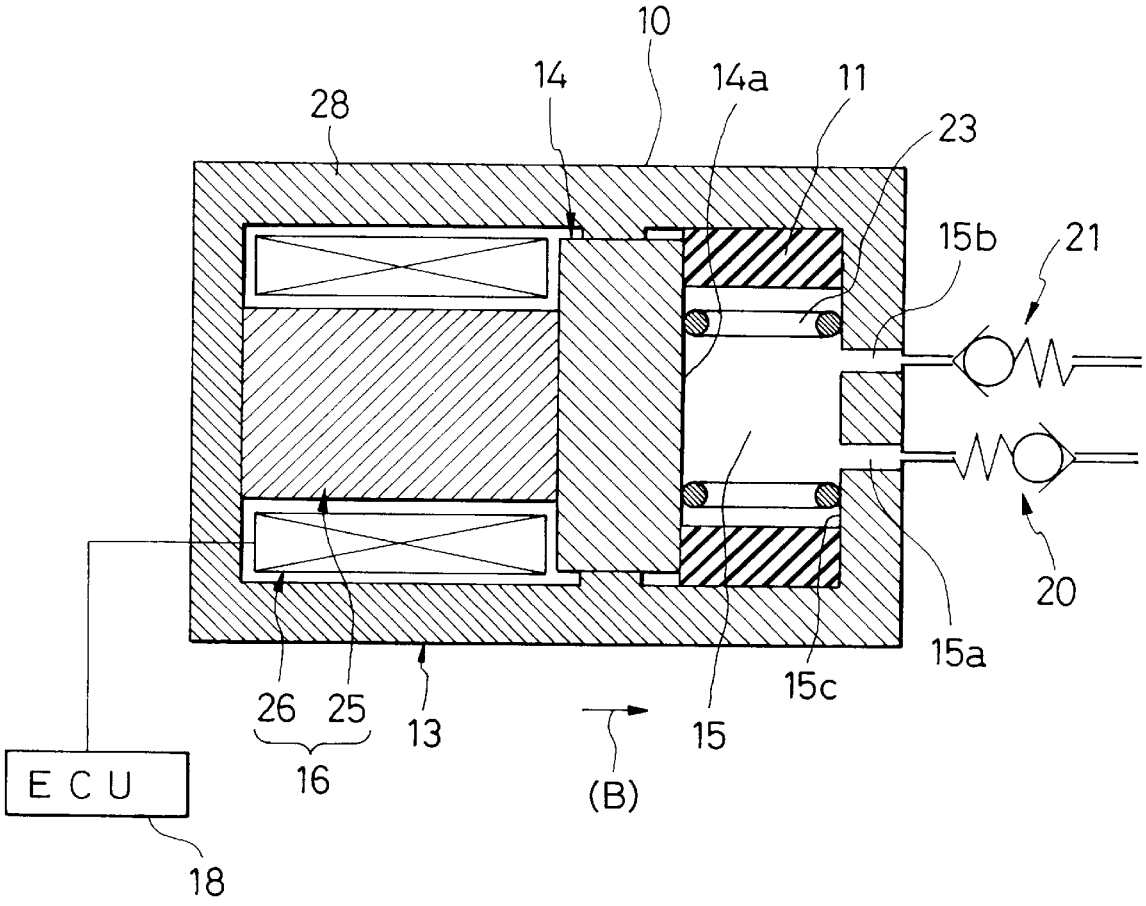
FIG. 1 is a vertical sectional view of a first embodiment of the hydraulic pump according to the present invention.
Figure 2A:
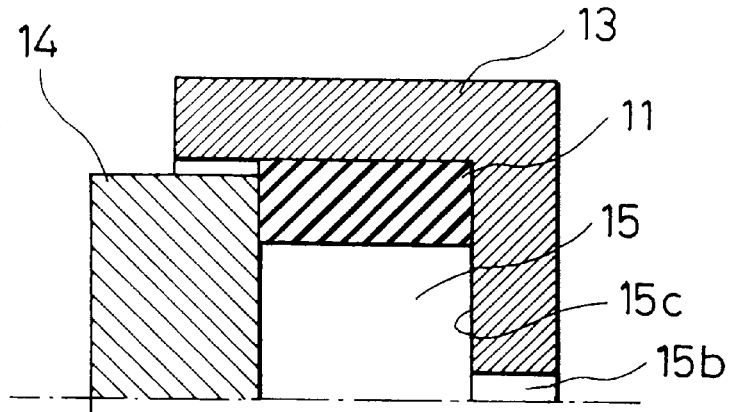
FIGS. 2(*a*) and 2(*b*) are sectional views of a main part showing the behavior of an elastic sealing member in a compression stroke and an expansion stroke of the hydraulic pump in the first embodiment of the present invention.
Figure 2B:
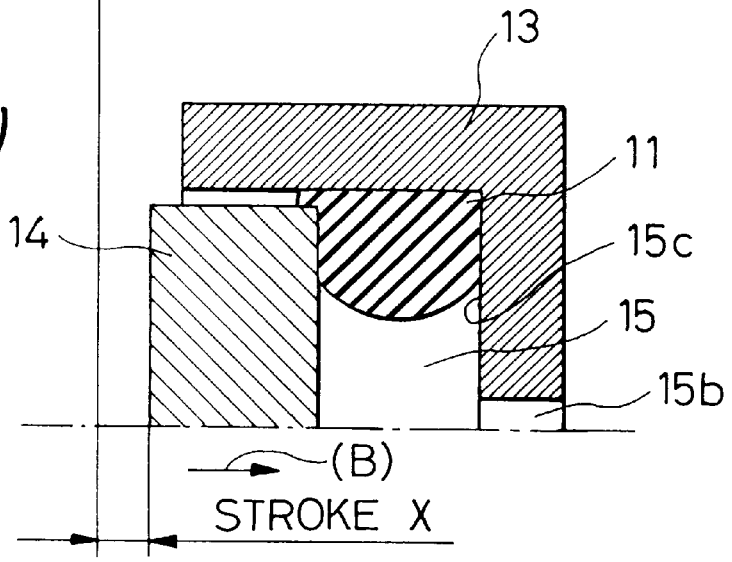

FIGS. 1 and 2 show a first embodiment of the hydraulic pump according to the present invention. FIG. 1 is a vertical sectional view of the hydraulic pump, and FIG. 2 is a sectional view of a main part showing the behavior of an elastic sealing member in the compression stroke and expansion stroke of the hydraulic pump.

For example, this hydraulic pump 10 is used as an electrically driven hydraulic pump for generating a high fluid pressure to press a friction pad against a disc rotor in a disc brake apparatus of a vehicle.

This hydraulic pump 10 comprises a cylinder 13, a slide piston 14 provided in the cylinder 13 so as to be able to reciprocate, an electrically driven actuator 16 for making the slide piston 14 reciprocate in the cylinder 13 to thereby compress/expand the volume of the pump chamber 15 in the cylinder 13, a control unit 18 for controlling the operation of the electrically driven actuator 16, a suction valve 20 for opening an inlet 15*a* provided in the pump chamber 15 in an expansion stroke (suction stroke) of the slide piston 14, a discharge valve 21 for opening an outlet 15*b* of the pump chamber 15 in a compression stroke (discharge stroke) of the slide piston 14, and an elastic sealing member 11 provided between the cylinder 13 and the slide piston 14 to prevent operating fluid in the pump chamber 15 from leaking out of a gap between the slide piston 14 and the cylinder 13, in which the fluid is discharged by the reciprocating motion of the slide piston 14.

In this first embodiment, the cylinder 13 has a relatively large diameter so that the slide piston 14 reciprocates as a piston for compressing/expanding the pump chamber 15. That is, in this first embodiment, the hydraulic pump 10 functions as a piston pump.

The electrically driven actuator 16 includes a compressed pre-stressed spring 23 provided between a front end surface 14*a* of the slide piston 14 and an end surface 15*c* of the pump chamber 15 opposite to the front end surface 14*a* to urge the slide piston 14 in a retreating direction (leftward in FIG. 1), a giant-magnetostrictive element 25 which is provided in the rear end side of the slide piston 14 to make the urging force of the pre-stressed spring 23 act through the slide piston 14 and which makes its length vary due to magnetostriction when a magnetic field is applied thereto, and an electromagnetic coil 26 for applying a magnetic field corresponding to an input current to the giant-magnetostrictive element 25, in which the slide piston 14 is reciprocated in the front-rear direction by an expanding/compressing operation due to the magnetic distortion of the giant-magnetostrictive element 25.

The pre-stress spring 23 functions as a return spring for urging the giant-magnetostrictive element 25 in the compressing direction to increase the quantity of the distortion of the giant-magnetostrictive element 25 when a magnetic field is applied thereto and, at the same time, for urging the slide piston 14 to return to its original position rapidly at the time of the compression/expansion of the giant-magnetostrictive element 25.

The giant-magnetostrictive element 25 is shaped like a round rod having an axis directed to the sliding direction of the slide piston 14. The electromagnetic coil 26 is shaped like a circular tube for covering the circumference of the giant-magnetostrictive element 25.

These giant-magnetostrictive element 25 and electromagnetic coil 26 are received and held in a cylindrical pump housing portion 28 united with the cylinder 13.

The control unit 18 controls the input current of the electromagnetic coil 26 so that the magnetic field applied to the giant-magnetostrictive element 25 changes periodically and the giant-magnetostrictive element 25 repeats the expanding/compressing operation. The control unit 18 includes an electric source for generating a current to be applied to the electromagnetic coil 26.

The suction valve 20 and the discharge valve 21 are check valves for opening/closing flow paths automatically on the basis of pressure acting on valve bodies at the time of the reciprocating motion of the slide piston 14.

The elastic sealing member 11 is provided annularly in the front end side of the slide piston 14 and along the inner circumferential surface of the cylinder 13 so that the elastic sealing member 11 receives a compression force from the front end surface 14*a* of the slide piston 14 in a compression stroke of the slide piston 14 and swells into the pump chamber 15 because of elastic deformation due to the compression force to thereby reduce the volume of the pump chamber 15.

More in detail, the elastic sealing member 11 in the first embodiment is provided so as to be cylindrical with its one end made to be in contact with the front end surface 14*a* of the slide piston 14, its other end made to be in contact with an end surface 15*c* of the pump chamber 15 opposite to the front end surface 14*a* of the slide piston 14, and its outer circumferential surface made to be in contact with the inner circumferential surface of the cylinder 13.

In the hydraulic pump 10 configured as described above, when no current conduction is applied to the electromagnetic coil 26, the giant-magnetostrictive element 25 is in a compressed state so that the slide piston 14 is located in an initial position farthest from the end surface 15*c* of the pump chamber 15 as shown in FIG. 2(*a*). In this condition, both the suction valve 20 and the discharge valve 21 close the flow paths respectively.

When current conduction is applied to the electromagnetic coil 26 from the control unit 18 so that the electromagnetic coil 26 generates a magnetic field, the giant-magnetostrictive element 25 is made to expand against the urging force of the pre-stressed spring 23 by the magnetic field so that the slide piston 14 is moved forward in the direction of the arrow (B) in FIGS. 1 and 2(*b*).

By the forward movement of the slide piston 14, the pump chamber 15 is compressed so that the operating fluid in the pump chamber 15 is discharged from the outlet 15*b*. In the compression stroke carried out by the slide piston 14, the elastic sealing member 11 is also compressed as shown in FIG. 2(*b*). By this compression, the sealing pressure due to the elastic sealing member 11 increases with the increase of the fluid pressure in the pump chamber 15, so that the sealing property of the elastic sealing member 11 is improved. At the same time, the elastic sealing member 11 is elastically deformed to swell into the pump chamber 15 so that the volume of the pump chamber 15 is reduced. That is, in the compression stroke of the slide piston 14, the elastic sealing member 11 acts to swell into the pump chamber 15 to push the operating fluid in the pump chamber 15 toward the outlet 15*b* in the same manner as in the slide piston 14.

Accordingly, the discharge quantity per movement stroke X of the slide piston 14 increases correspondingly to the discharge quantity of the operating fluid due to the swelling of the elastic sealing member 11, so that the discharge efficiency is improved.

When the application of the current conduction to the electromagnetic coil 26 from the control unit 18 is turned off, the magnetic field in the electromagnetic coil 26 disappears so that the giant-magnetostrictive element 25 is compressed to its original length. In this occasion, with the compression of the giant-magnetostrictive element 25, the slide piston 14 is retreated by the urging force of the pre-stressed spring 23. By the retreat of the slide piston 14, the mode of the pump chamber 15 changes from the compression stroke to an expansion stroke so that the operating fluid in a reservoir tank not shown is sucked up through the suction valve 20. At the same time, the elastic sealing member 11 returns to the original state shown in FIGS. 1 and 2(*a*) because the compression due to the slide piston 14 is released.

That is, in the hydraulic pump 10 in the first embodiment, the elastic sealing member 11 swells into the pump chamber 15 to reduce the volume of the pump chamber 15 in the compression stroke due to the slide piston 14. As a result, the discharge quantity from the outlet 15*b* in one movement stroke of the slide piston 14 increases correspondingly to the reduction of the volume of the pump chamber 15 due to the swelling of the elastic sealing member 11, so that the discharge efficiency is improved.

Furthermore, the operation and effect of such an elastic sealing member 11 are obtained by improvement in the position of the arrangement of the elastic sealing member 11. Even in the case where fitting accuracy in the cylinder 13, the piston, etc. is not improved, the disadvantage that the volume of the pump chamber increases because of the displacement and deformation of the elastic sealing member in the compression stroke, can be prevented.

Accordingly, assembling property is good and, further, the discharge efficiency can be improved.

Further, after the elastic sealing member 11 is provided so as to be cylindrical with its one end made to be in contact with the front end surface 14*a* of the slide piston 14, its other end made to be in contact with an end surface 15*c* of the pump chamber 15 opposite to the front end surface 14*a* of the slide piston 14, and its outer circumferential surface made to be in contact with the inner circumferential surface of the cylinder 13, so that the elastic sealing member 11 can be positioned in a predetermined position by a simple operation of bringing the slide piston 14 into contact with the end portion of the elastic sealing member 11 after the elastic sealing member 11 is pressed into the pump chamber 15.

Accordingly, the sealing groove into which the elastic sealing member 11 is fitted is not necessary to be formed in the inner surface of the cylinder 13 or in the outer circumferential surface of the slide piston 14. The structure of the cylinder 13 or the slide piston 14 can be simplified to reduce the cost of production. Further, the positioning operation at the time of assembling the elastic sealing member 11, or the like, can be facilitated to improve the assembling property more greatly.

Figure 3:
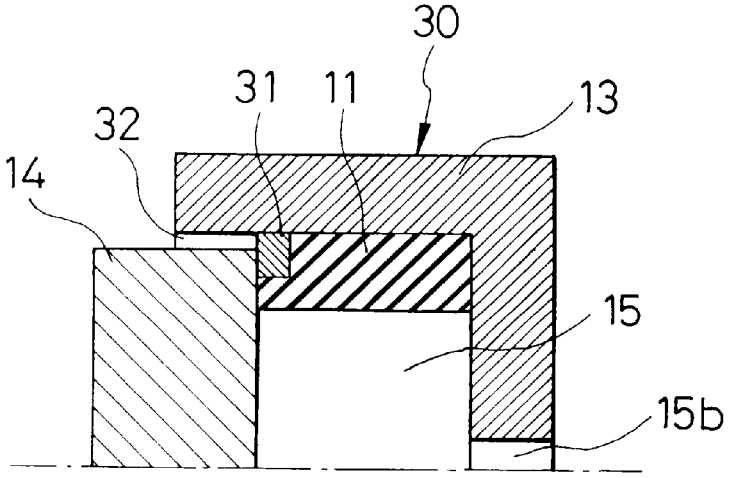
FIG. 3 is a sectional view of a main part of a second embodiment of the hydraulic pump according to the present invention.
Figure 4:
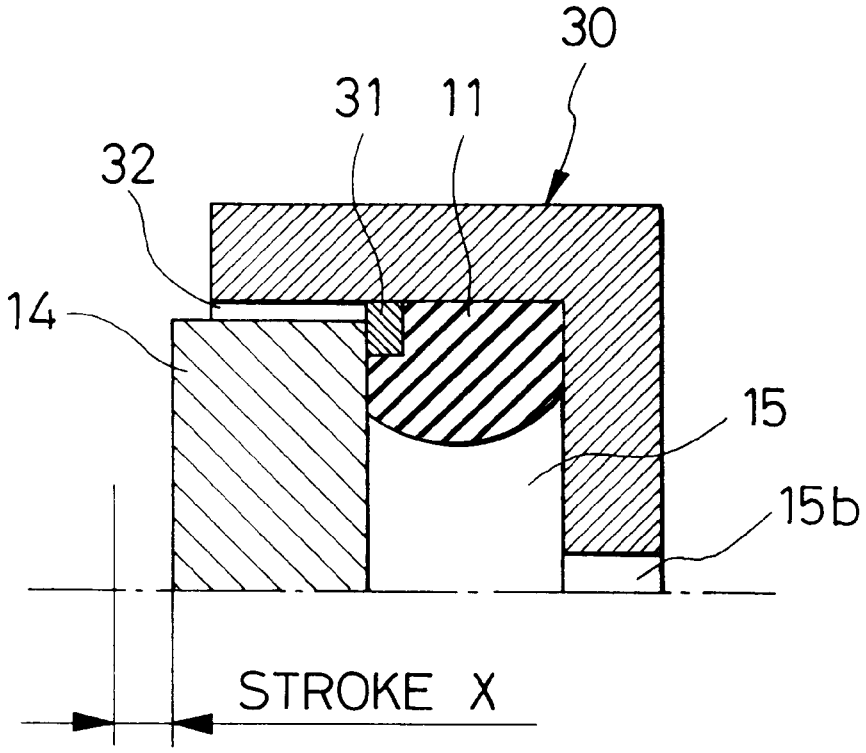
FIG. 4 is a sectional view of a main part showing the behavior of an elastic sealing member in a compression stroke of the hydraulic pump in the second embodiment of the present invention.

FIGS. 3 and 4 show a second embodiment of the hydraulic pump according to the present invention. FIG. 3 is a sectional view of a main part of the hydraulic pump in the second embodiment, and FIG. 4 is a sectional view of a main part showing the behavior of the elastic sealing member in the compression stroke of the hydraulic pump.

The hydraulic pump 30 in the second embodiment is designed so that the structure of the elastic sealing member 11 for performing sealing between the slide piston 14 and the cylinder 13 is improved partially.

The elastic sealing member 11 in the second embodiment is configured so that a cover plate 31 formed from a metal or rigid resin material is embedded in an end portion of the elastic sealing member 11 which is in contact with the front end surface 14*a* of the slide piston 14.

The cover plate 31 is provided so as to block a gap 32 of a fitting portion between the slide piston 14 and the cylinder 13.

By providing the cover plate 31 in such a manner, a part of the elastic sealing member 11 is prevented securely from leaking into the gap 32 of the fitting portion between the slide piston 14 and the cylinder 13 in the compression stroke due to the slide piston 14, as shown in FIG. 4. Accordingly, the quantity of the elastic sealing member 11 swollen into the pump chamber 15 in the compression stroke can be maximized.

Figure 5:
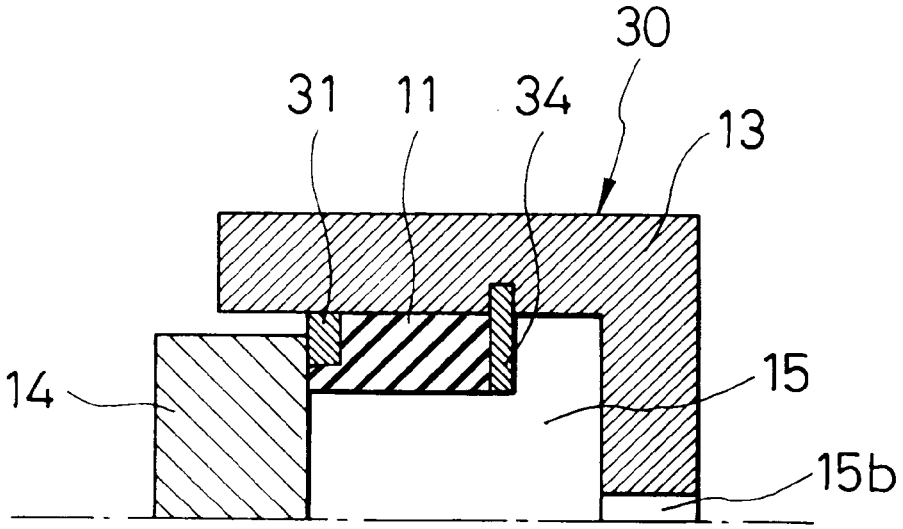
FIG. 5 is a sectional view of a main part of a third embodiment of the hydraulic pump according to the present invention.
Figure 6:
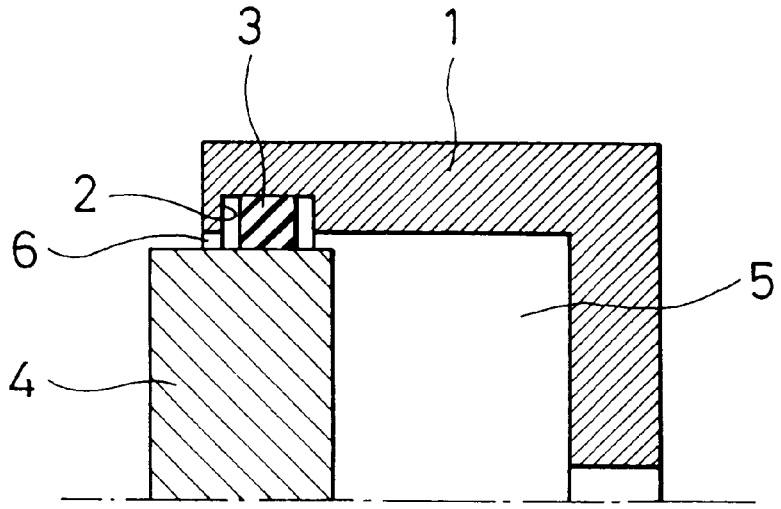
FIG. 6 PRIOR ART
FIG. 6 is a sectional view of a main part showing the structure of the arrangement of an elastic sealing member in a conventional hydraulic pump.
Figure 7:
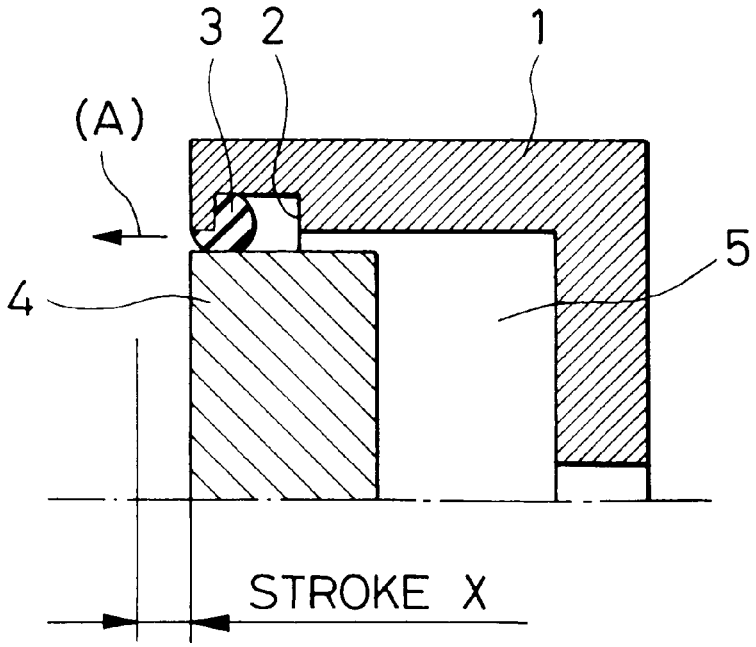
FIG. 7 PRIOR ART
FIG. 7 is a sectional view of a main part showing the behavior of the elastic sealing member in a compression stroke of the conventional hydraulic pump shown in FIG. 6.

Although the aforementioned embodiments have shown the case where the elastic sealing member 11 is shaped cylindrical over the whole depth of the pump chamber 15, the present invention may be applied also to the case where the elastic sealing member 11 is shaped like a ring shorter than the whole depth of the pump chamber 15 so that the front end side of the elastic sealing member 11 is brought into contact with a stop ring 34 built in the cylinder 13, as shown in FIG. 5.

Although the aforementioned embodiments have shown the case of a piston pump using a cylinder 13 having a relatively large diameter and a piston as the slide piston 14, the present invention can be applied also to the case of a plunger pump using a cylinder 13 having a relatively small diameter and using a round-rod-like plunger as the slide piston 14.

Further, the fluid discharged by the hydraulic pump according to the present invention is not limited to a liquid such as brake oil, or the like. A gas can be used also, so that the hydraulic pump according to the present invention can be applied to an oil pump, an air compressor, etc. for various purposes.

Further, in the hydraulic pump according to the present invention, the driving source for making the slide piston 14 reciprocate in the cylinder 13 is not limited to the giant-magnetostrictive element described in the aforementioned embodiments. The giant-magnetostrictive element may be replaced by a piezoelectric element or by a known driving source or driving mechanism used in the conventional piston pump or plunger pump.

In the hydraulic pump according to the present invention, the elastic sealing member swells into the pump chamber to reduce the volume of the pump chamber in a compression stroke of the slide piston, so that the quantity of the fluid discharged from the outlet in a stroke of the movement of the slide piston increases correspondingly to the reduction of the volume of the pump chamber due to the swelling of the elastic sealing member to thereby improve the discharge efficiency.

Furthermore, the operation and effect of such an elastic sealing member are obtained by improvement in the position of the arrangement of the elastic sealing member. Even in the case where fitting accuracy in the cylinder, the piston, etc. is not improved, the disadvantage that the volume of the pump chamber increases because of the displacement and deformation of the elastic sealing member in the compression stroke, can be prevented.

Accordingly, a hydraulic pump excellent in assembling property and excellent in discharge efficiency can be provided.

Further, in the case where configuration is made so that the elastic sealing member is provided so as to be cylindrical with its one end made to be in contact with the front end surface of the slide piston, its other end made to be in contact with an end surface of the pump chamber opposite to the front end surface of the slide piston, and its outer circumferential surface made to be in contact with the inner circumferential surface of the cylinder, the sealing groove into which the elastic sealing member is fitted is not necessary to be formed in the inner surface of the cylinder or in the outer circumferential surface of the slide piston. Accordingly, the structure of the cylinder or slide piston can be simplified to reduce the cost of production and, further, an positioning operation, or the like, at the time of assembling the elastic sealing member can be facilitated to improve the assembling property more greatly.

What is claimed is:

1. A hydraulic pump comprising:

a cylinder having a pump chamber;

a slide piston positioned within said cylinder such that a gap is formed between a portion of said piston and the cylinder, said piston reciprocating in said pump chamber so as to compress and expand a volume of said pump chamber, whereby a fluid in said pump chamber is discharged; and an elastic sealing member disposed between said cylinder and said slide piston while being compressed so as to prevent said fluid in said pump chamber from leaking out of said gap between said slide piston and said cylinder, wherein said elastic sealing member is disposed on a front end side of said slide piston and along an inner circumferential surface of said cylinder so that said elastic sealing member receives a compression force from a front end surface of said slide piston in a compression stroke of said slide piston and is caused to swell into said pump chamber by elastic deformation due to said compression force to thereby reduce the volume of said pump chamber.

2. The hydraulic pump according to claim 1, wherein said elastic sealing member has a cylindrical shape, and one end of said elastic sealing member is in contact with the front end surface of said slide piston, another end of said elastic sealing member is in contact with an end surface of said pump chamber opposite to the front end surface of said slide piston, and an outer circumferential surface of said elastic sealing member is in contact with the inner circumferential surface of said cylinder.

3. The hydraulic pump according to claim 1, further comprising a cover plate embedded in an end portion of said elastic sealing member so as to be in contact with the front end surface of said slide piston and block the gap between said slide piston and said cylinder, so that a part of said elastic sealing member is prevented securely from leaking into the gap in the compression stroke of said slide piston.

4. The hydraulic pump according to claim 2, further comprising a cover plate embedded in an end portion of said elastic sealing member so as to be in contact with the front end surface of said slide piston and block the gap between said slide piston and said cylinder, so that a part of said elastic sealing member is prevented securely from leaking into the gap in the compression stroke of said slide piston.

5. The hydraulic pump according to claim 1, further comprising a stop ring projected from said inner circumferential surface of said cylinder, and said elastic sealing member is shaped cylindrical, and one end of said elastic sealing member is in contact with the front end surface of said slide piston, another end of said elastic sealing member is in contact with said stop ring, and an outer circumferential surface of said elastic sealing member is in contact with the inner circumferential surface of said cylinder.

6. The hydraulic pump according to claim 5, further comprising a cover plate-embedded in an end portion of said elastic sealing member so as to be in contact with the front end surface of said slide piston and block the gap between said slide piston and said cylinder, so that a part of said elastic sealing member is prevented securely from leaking into the gap in the compression stroke of said slide piston.

7. The hydraulic pump according to claim 1, wherein said elastic sealing member is in a cylindrical shape, and said piston is always brought into contact with said elastic sealing member while said piston is located between an upper dead point and a lower dead point.

8. A hydraulic pump comprising:

a cylinder having a pump chamber;

a slide piston positioned within said cylinder such that a gap is formed between a portion of said piston and the cylinder, said piston reciprocating in said pump chamber so as to compress and expand a volume of said pump chamber, whereby a fluid in said pump chamber is discharged;

an elastic sealing member disposed between said cylinder and said slide piston while being compressed so as to prevent said fluid in said pump chamber from leaking out of said gap between said slide piston and said cylinder; and a cover plate embedded in an end portion of said elastic sealing member so as to be in contact with the front end surface of said slide piston and block the gap between said slide piston and said cylinder, so that a part of said elastic sealing member is prevented securely from leaking into the gap in the compression stroke of said slide piston, wherein said elastic sealing member is disposed on a front end side of said slide piston and along an inner circumferential surface of said cylinder so that said elastic sealing member receives a compression force from a front end surface of said slide piston in a compression stroke of said slide piston and is caused to swell into said pump chamber by elastic deformation due to said compression force to thereby reduce the volume of said pump chamber.

9. The hydraulic pump according to claim 8, further comprising a stop ring projected from said inner circumferential surface of said cylinder, and said elastic sealing member has a cylindrical shape, and one end of said elastic sealing member is in contact with the front end surface of said slide piston, another end of said elastic sealing member is in contact with said stop ring, and an outer circumferential surface of said elastic sealing member is in contact with the inner circumferential surface of said cylinder.

10. A hydraulic pump comprising:

a cylinder having a pump chamber;

a slide piston positioned within said cylinder such that a gap is formed between a portion of said piston and the cylinder, said piston reciprocating in said pump chamber so as to compress and expand a volume of said pump chamber, whereby a fluid in said pump chamber is discharged;

an elastic sealing member disposed between said cylinder and said slide piston while being compressed so as to prevent said fluid in said pump chamber from leaking out of said gap between said slide piston and said cylinder; and a cover plate embedded in an end portion of said elastic sealing member so as to be in contact with the front end surface of said slide piston and block the gap between said slide piston and said cylinder, so that a part of said elastic sealing member is prevented securely from leaking into the gap in the compression stroke of said slide piston.

* * * * *